United States Patent [19]

Bobo

[11] 4,178,234

[45] Dec. 11, 1979

[54] ROTATING CYCLONE CENTRIFUGE APPARATUS

[76] Inventor: Roy A. Bobo, 2000 N. Loop West, Houston, Tex. 77018

[21] Appl. No.: 926,441

[22] Filed: Jul. 20, 1978

[51] Int. Cl.[2] ..... B04C 5/107; B04C 5/13

[52] U.S. Cl. ..... 209/211; 233/28

[58] Field of Search ..... 209/211, 144; 210/512 R; 55/459 R, 457, 419, 203, 204; 233/DIG. 1, 1 A, 27, 28

[56] References Cited

U.S. PATENT DOCUMENTS

| | | | |
|---|---|---|---|
| 2,893,557 | 7/1959 | Teuteberg | 209/211 X |
| 3,648,840 | 3/1972 | Bobo | 209/211 |
| 3,859,206 | 1/1975 | Baggaley | 209/211 X |
| 3,893,914 | 7/1975 | Bobo | 209/211 X |
| 3,893,922 | 7/1975 | Bobo | 209/211 |
| 3,990,634 | 11/1976 | Hejlek | 55/17 X |

*Primary Examiner*—Ralph J. Hill
*Attorney, Agent, or Firm*—Pravel, Gambrell, Hewitt, Kirk, Kimball & Dodge

[57] ABSTRACT

A new and improved rotating cyclone centrifuge apparatus having an accelerator (A) which receives a liquid feed having solid particles to be separated therefrom in an axial direction and discharges it radially outwardly in a helical flow through diametrically opposite chokes (40*b*) into a separation chamber (10*c*) whose diameter substantially coincides with the outer extremities of the chokes, whereby the fluid flow is first brought up to the velocity of the rotating apparatus and is further accelerated in excess of the velocity of the rotating apparatus as the fluid enters the separation chamber without plugging of entranceways or of the chokes by the solids in the liquid feed. The liquid feed is precisely separated into a heavy phase which has the heavier particles and a light phase which has the bulk of the liquid and lighter particles, both of which are discharged from the same end of the separation chamber, and opposite from the feed inlet end. Means (42) is provided for stabilizing an air core for the light phase discharge, and also means (30, 33) is provided to readily adjust the split between the light and heavy phases discharged from the apparatus.

10 Claims, 7 Drawing Figures

ROTATING CYCLONE CENTRIFUGE APPARATUS

DESCRIPTION

Technical Field

This invention relates to cyclone and rotating cyclone apparatus for the separation of heavy and light solid phases in a liquid.

Background Art

U.S. Pat. Nos. 3,648,840 and 3,893,914 disclose rotating cyclone centrifuges invented by the present applicant. In the apparatus of both of such patents, the inlet fluid feed was passed through flow path and restricted area prior to passage into the separation chamber that was conductive to plugging of solids. The seal arrangement in the apparatus of U.S. Pat. No. 3,648,840 was designed for solid shafts, necessitating the use of flush water and a consequent tendency for entrapment of solids, and additionally, the light phase was to be separated at the same end of the apparatus as the inlet feed. In U.S. Pat,. No. 3,893,914, the light and heavy phases were separated at the opposite end from the inlet feed, but it was found difficult to obtain a sharp controlled separation of the two phases.

DISCLOSURE OF THE INVENTION

In accordance with the present invention, a new and improved rotating cyclone centrifuge apparatus is provided which is an improvement on the apparatus of said prior art. The inlet feed is introduced from an axial inlet opening through an accelerator having restricted inlet openings or chokes whose outer extremities are substantially equal to the bore of the separation chamber. A stabilized air core and a vortex finder are provided in substantially the central portion of the separation chamber for the removal of the light phase solids with liquid, while the heavy phase solids are discharged through the side of the chamber near the same end as the light phase, whereby a precisely controlled split between the two phases is effected.

Plugging of the solids is thus avoided while obtaining closely controlled separation of the light and heavy phases.

Figure 1:
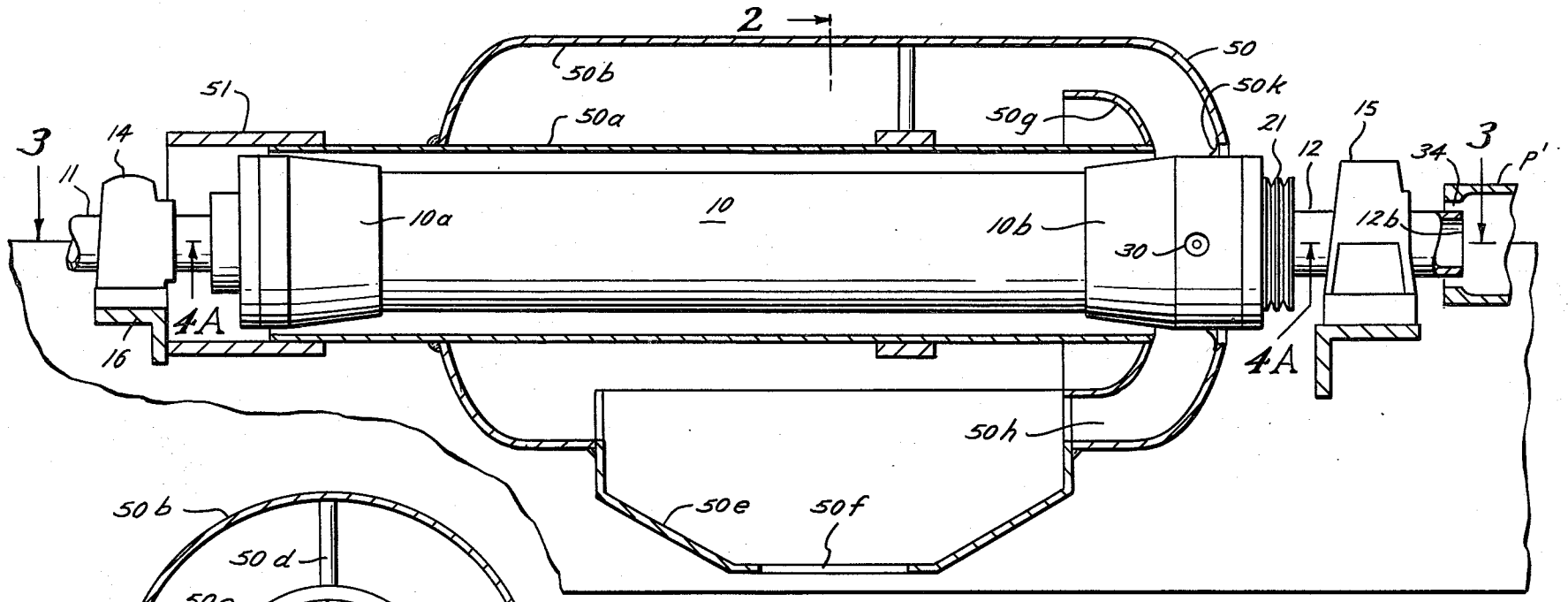
FIG. 1 is a side view in elevation, and partly in section, of the rotating cyclone centrifuge apparatus of this invention.

Best Mode for Carrying Out the Invention

In the drawings, the numeral 10 designates the housing or bowl of the apparatus of this invention, having an inlet flange 10*a* at one end and an outlet flange 10*b* at the other end, each of which is permanently attached to the housing or bowl 10 by suitable means such as threading, silver solder, epoxy resin or the like.

The housing or bowl 10 is suspended on a hollow inlet shaft 11 and a hollow outlet shaft 12, which are supported in conventional pillow block bearings 14 and 15, respectively. The pillow blocks 14 and 15 are mounted on cross support members 16 and 17 by cap screws 14*a* and 15*a*, respectively, or any other suitable attaching means. The cross members 16 and 17 are welded or are otherwise affixed to main support members 19 and 20 (FIGS. 2 and 3) which rest upon a suitable foundation or base B.

Within the housing or bowl 10, an accelerator A is mounted for receiving the inlet feed which preferably is a liquid having solid particles of varying densities which are to be separated from each other. The accelerator A will be described more in detail hereinafter, but generally, its purpose is to receive the inlet feed in an axial direction and distribute it in a helical path to the internal portion of the housing 10 which is a separating chamber 10*c*.

The apparatus portion illustrated in FIGS. 1–3 and 4A are rotated by any suitable means such as an electric motor or other prime mover which is connected to a sheave 21 (FIGS. 1, 3 and 4A) which has suitable grooves 21*a* for receiving a plurality of drive belts connected to such electric motor or other prime mover. The apparatus is thus rotated in its bearing supports 14 and 15, and as best seen in FIG. 4B. The rotatable hollow inlet shaft 11 is connected through a suitable seal S to a stationary outlet pipe P so that the inlet feed may be introduced into the apparatus of this inventin axially, as will be more evident hereinafter.

Considering the apparatus of this invention more in detail, the housing 10 includes an internal liner 10*d* for abrasion resistance and is preferably a plastic material such as polyurethane. At the righthand end of the apparatus as viewed in FIG. 4A, the sheave 21 is secured to the outlet flange or ring 10*b* by cap screws 21*b* or any other suitable attaching means so that the rotation of the sheave 21 is transmitted through the outlet ring flange 10*b* to the housing 10 and thus to the portion of the apparatus at the other end of the housing 10.

The housing 10 and its liner 10*d* are provided with heavy phase discharge openings 10*e* for the discharge of the separated heavy phase. A choke 30 is mounted in each opening 10*f* of the outlet flange 10*b* in alignemtn with each of the openings 10*e*. Each choke 30 is made of tungsten carbide or other suitable highly abrasion resistant material and is provided with a bore 30*a* of predetermined size for controlling the split or division between the heavy phase and the light phase, as will be more fully explained. The chokes 30 are mounted with a seal ring 31 of rubber or other material to prevent fluid flow around the chokes 30, and they are removably positioned in the openings 10*f* by snap rings 32 or any other suitably removable attachment or mounting means. In this manner, the chokes 30 may be readily changed to provide for chokes having different sizes of the bores 30*a* to thereby predetermine the amount of the heavy phase discharged therethrough. The number of such chokes 30 and the openings therethrough are also subject to variation, as will be understood by those skilled in the art. It will be noted that the heavy phase discharge openings provided by the chokes 30 are located at the opposite end from the accelerator A where the inlet feed enters the separating chamber 10*c*.

Figure 4B:
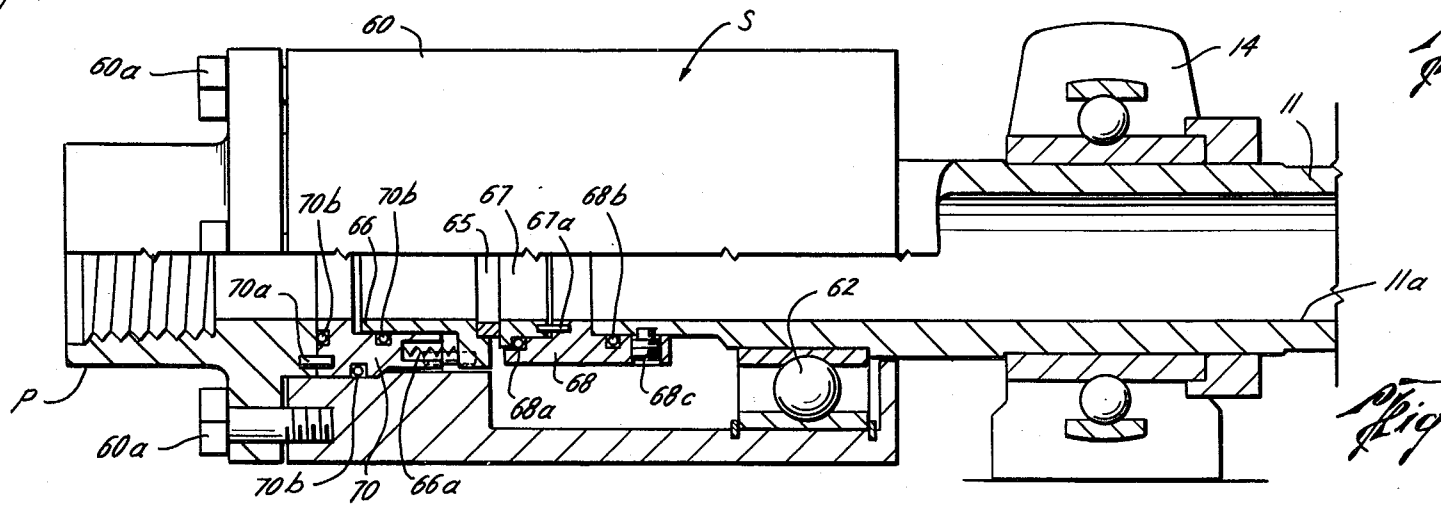
FIG. 4B is a sectional view, partly in elevation, illustrating a floating seal or rotating union which is connected to the left of the apparatus shown in FIG. 4A and it provides for the sealed connection between the stationary portion of the apparatus and the rotatable portion of the apparatus.
Figures 4A, 5, 6:
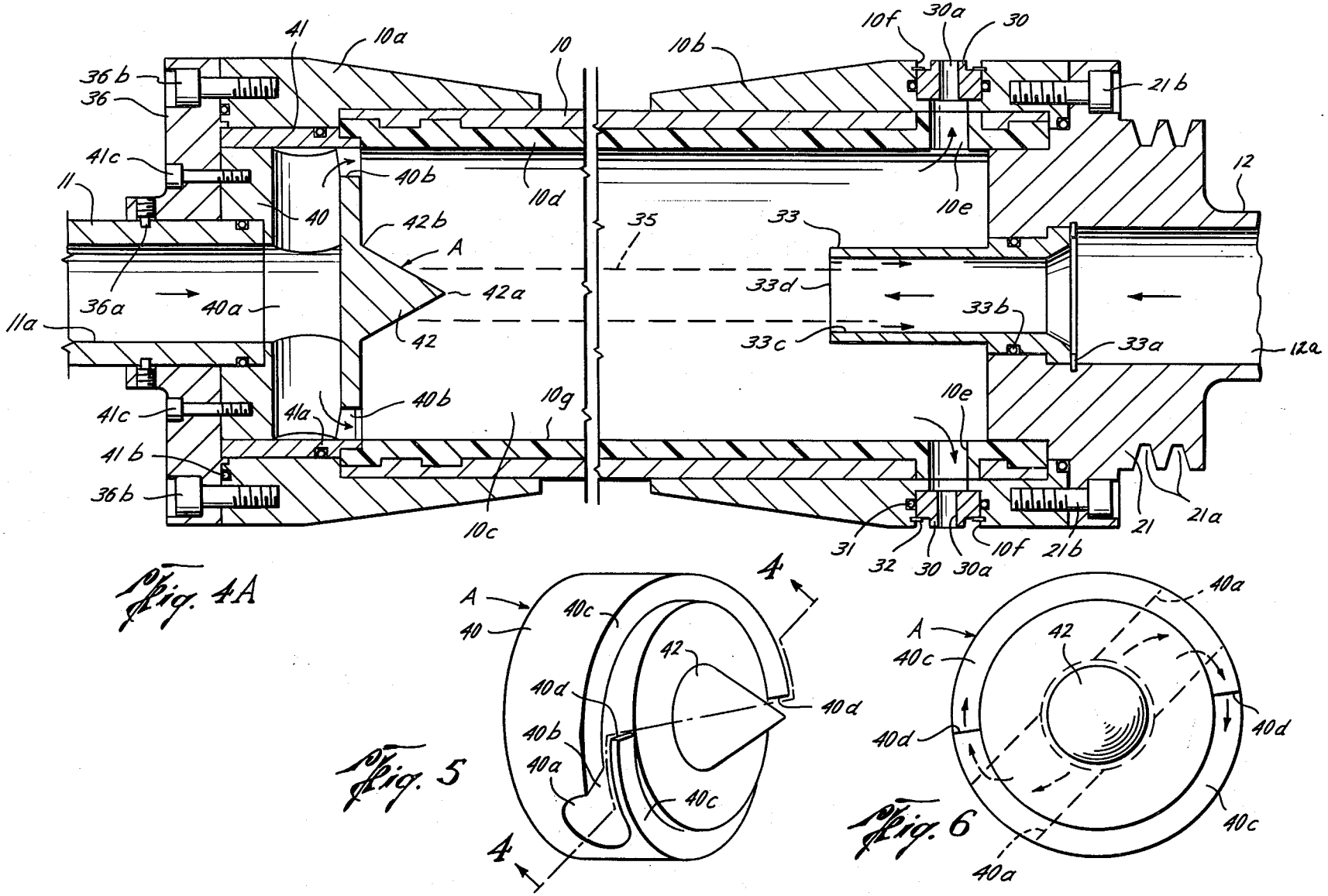
FIG. 4A is an enlarged sectional view taken along line 4A—4A of FIG. 1 to further illustrate the internal construction of the apparatus of FIG. 1.
FIG. 5 is an isometric view of the accelerator in the apparatus of this invention.
FIG. 6 is a plan view of the accelerator of FIG. 5, showing further details thereof.

The light phase discharge from the separating chamber 10*c* occurs through bore 12*a* of the hollow shaft 12 (FIG. 4A), and to facilitate the precise separation between the heavy phase and the light phase discharges, a rotatable re-entrant discharge tube 33 is removably mounted in such bore 12*a* (FIG. 4A). The tube 33 is mounted for ready removal and replacement by means of a metal snap ring 33*a* or any other suitable removable attaching means. A seal ring 33*b* of rubber or the like is used to seal around the external surface of the re-entrant discharge tube 33. The size of the bore 33*c* of the tube 33 is predetermined to further serve as a control on the split or division of flow between the heavy phase and the light phase separation. It is to be noted that the inner end 33*d* of the tube 33 projects inwardly into the separation chamber 10*c* beyond the oulet chokes 30 so as to prevent a bypass of the heavy phase with the light phase, whereby a more precise or accurate delineation between the heavy phase and the light phase is effected.

Also, it should be noted that the discharge end 12*b* of the hollow shaft 12 is open and discharges into a stationary pipe or tube P'. The pipe P' is of a larger diameter than the hollow shaft 12 so that air may enter through the annular space 34 so that air forms a central air core within the separating chamber, substantially in the central portion of the light phase central section or column 35 indicated in dash lines in FIG. 4A. The air is drawn into the separation chamber to form such central air core because of the partial vacuum or reduced pressure which is generated at such central portion due to the rotation and also the free vortex of the liquid flowing from the inlet to the outlet of the chamber 10*c*, as will be more evident hereinafer.

At the inlet end of the apparatus A, the inlet shaft 11 is connected to the housing 10 through an end flange 36 which is fastened by set screws 36*a* or other suitable means to the shaft 11 and it is also fastened to the inlet ring 10*a* by cap screws 36*b* or other suitable attaching means. The accelerator A has a generally cylindrical body 40 and it fits within an accelerator sleeve 41 between the accelerator A and the inlet ring 10*a*. Suitable seal rings 41*a* and 41*b* are preferably provided. The accelerator body 40 is secured in position by cap screws 41*c* which extend through the end flange 36 into the base of the body 40 (FIG. 4A).

The accelerator A has a special configuration which enables the inlet feed to enter the separation chamber 10*c* from the axial hollow shaft 11 without plugging by the solids at the entry to the separation chamber 10*c*. The body 40 has a pair of diametrically opposite lateral passages 40*a*. Preferably, the sum of the cross-sectional area of the two diametrically opposite passages 40*a* are equal to the cross-sectional area of the bore 11a of the inlet shaft 11 to prevent any restriction to the inlet feed flow at that area. The lateral passage 40*a* terminates and communicates with restricted inlet openings 40*b* which are preferably diametrically opposed to each other and which are of a smaller cross-sectional area than the cross-sectional area of the passage 40*a* to provide a choke or restriction of the flow of the liquid inlet feed therethrough, which creates a pressure drop and an increased velocity of the liquid in excess of the velocity imparted to the liquid by the rotation of the accelerator A with the housing 10. Thus, a free vortex is created by the chokes 40*b* in addition to the forced vortex created by the rotation of the accelerator A. It is also to be noted that the outer extremities of the inlet chokes or restricted openings 40*b* are at exactly the same diameter, or substantially the same diameter, as the outer extremity of the inner bore 10*g* of the housing 10 which is provided by the inner bore of the liner 10*d*. The direction of flow of the inlet feed is in a helical path along the walls of the inner bore 10*g* and this is caused by helical surfaces or vanes 40*c* which are preferably machined integrally with the body 40. In the preferred form of the invention, there are wo of such helical surfaces or vanes 40*c* and it is to be noted that the ends 40*d* extend beyond and overlap the inlet choke openings 40*b* so that they actually form the upper or inner portion of the restricted openings 40*b*. Although the preferred number of choke inlet opening is the two indicated in the preferred embodimnt illustrated in the drawings, such number could be varied under some conditions.

The accelerator A also has therewith a central stabilizer cone 42 which is preferably integral with the body 40 but may be a separate member welded or otherwise secured to the body 40. The cone 42 is a stabilizer for the air core or central light phase discharge column 35. To accomplish such stabilization, the stabilizer cone 42 is formed with its base diameter substantially equal to the diameter of the bore 33*c* of the re-entrant discharge tube 33, and they are aligned with each other so that the point or tip 42*a* of the cone 42 is in line with the central axis of the tube 33 and the outer base 42*b* of the stabilizer 42 is in alignment with the bore 33*c* of the tube 33.

Figure 2:
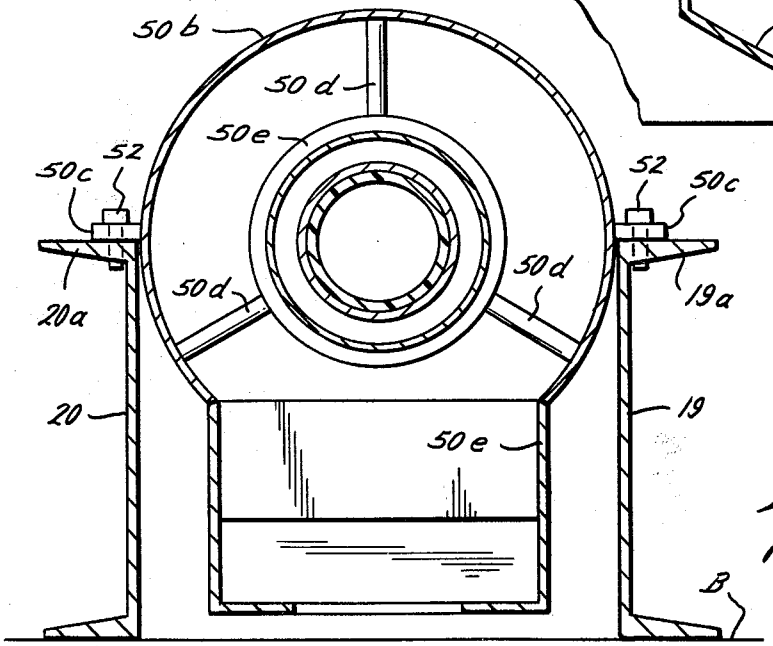
FIG. 2 is a sectional view taken along line 2—2 of FIG. 1.
Figure 3:
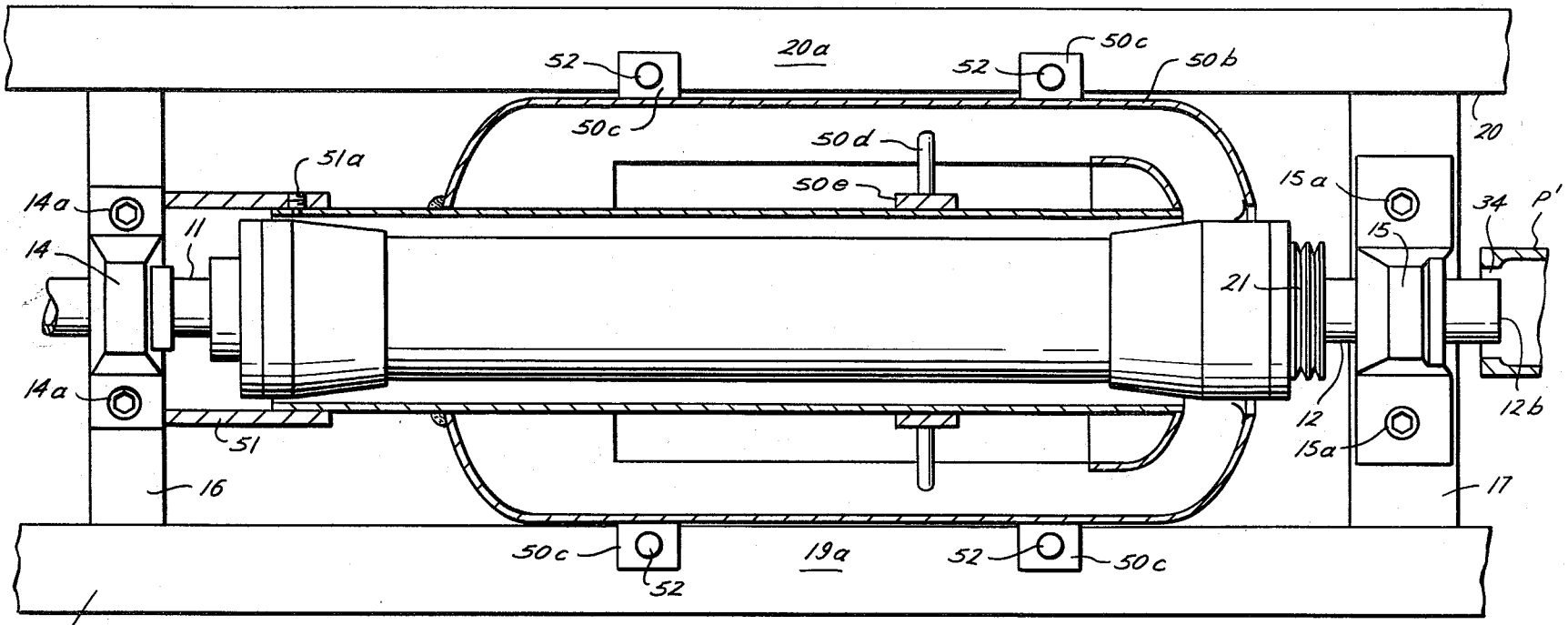
FIG. 3 is a view, partly in elevation and partly in section, taken along line 3—3 of FIG. 1 to further illustrate the apparatus of this invention in its preferred embodiment.

Referring now to FIGS. 1–3 in particular, a heavy phase receiving assembly 50 is illustrated in position surrounding the housing 10 for receiving the heavy phase discharge from the choke openings 30 and for also serving as a guard and protective covering from the rotating portion of the apparatus. The heavy phase receiving assembly 50 does not rotate and it includes a central tube 50*a* which supports a guard tube 51 which is located by set screws 51*a* to provide a releasable connection for sliding the tube 51 to the right to expose cap screws 36*b* for removal and to provide access to the pillow block 14, shaft 11 and/or accelerator 40 when desired.

An outer enclosure 50*b* surrounding the inner tube 50*a* is mounted on the support members 19 and 20 by ears 50*c* which are welded or are otherwise affixed to such outer enclosure or shell 50*b* and which are fastened to flanges 19*a* and 20*a*, respectively, by cap screws 52 or any other suitable attaching means. The tube 50*a* is further supported within the enclosure 50*b* by pins 50*d* which are welded or otherwise secured at approximately 120° apart to a support ring 50*e* which surrounds the tube 50*a* (FIGS. 2 and 3).

The bottom portion of the outer enclosure 50*b* has a sump 50*e* for receiving the heavy phase discharge and for controlling its outlet flow through opening 50*f* to a suitable recovery point. To deflect the heavy phase discharge from the chokes 30, a generally elliptical portion 50*g* is formed with the tube 50*a* so as to create an elliptical channel 50*h* for directing the heavy phase discharge to the central portion of the receiving unit 50 and ultimately to the sump 50*e* for discharge through the opening 50*f*. A seal 50*k* of rubber or other suitable material is provided in contact with the external surface of the ring 10*b* to confine the heavy phase discharge fluid within such channel 50*h*.

Referring now in particular to FIG. 4B, the seal S includes a seal chamber housing 60 which is held against rotation by its connection to the pipe P with suitable bolts 60*a* or other connecting means. Anti-friction bearings 62 are provided between the seal housing 60 and the end of the rotating inlet shaft 11. It will be understood that the pipe P is connected to a suitable hose or other piping which connects to a source of the liquid feed which is to be separated into its heavy phase and its light phase in the apparatus of this invention. Such inlet feed is transmitted under pressure into said inlet pipe P and thus it flows through the seal S and into the bore of the hollow shaft 11. The seal itself may take numerous forms, but as illustrated in FIG. 4B, a seal ring or element 65 is held in position between a fixed cylinder 66 and a rotating cylinder 67 by means of a spring 66*a* constantly urging the sleeve 66 and thus the seal ring 65 into engagement with the ring 67. The ring 65 is preferably formed of "Teflon", stainless steel, or other suitable sealing material and the parts which function to accomplish the seal are readily replaceable. The rotatable seal member 67 is secured to the end of the hollow shaft 11 by a sleeve 68 having a plurality of set screws 68*c* for attachment to the sleeve 11. A plurality of O-rings 68*a* and 68*b* are provided for seals. The seal ring 67 rotates with the sleeve 68 due to pins 67*a* or other suitable interconnecting means with the sleeve 68 so that the seal ring 67 rotates with the hollow shaft 11 which is rotated with the rest of the apparatus through the rotation of the sheave 21, as previously noted.

The fixed cylinder 66 which serves to maintain a constant pressure on the seal ring 65 for sealing engagement with the ring 67 is held in position by any suitable means such as sleeve 70 which is connected by pins 70*a* or other suitable means to the pipe P. Also, suitable O-rings 70*b* are provided for sealing off the fluid with respect to such parts.

In the operation or use of the apparatus of this invention, the inlet feed enters the pipe P from a source of fluid under pressure such as a pump (not shown) which supplies the liquid which has solid particles of varying densities and coarseness therewith which are to be separated into a heavy phase and a light phase. The fluid feed inlet flows through the seal S into the bore 11*a* of the hollow shaft 11 and thence into the lateral passage 40*a* of the accelerator A. From there, the fluid feed inlet is caused to rotate in a helical path as it discharges through the inlet chokes 40*b* and enters the separation chamber 10*c*. Since the housing 10 and accelerator A are rotating together, the inlet feed has a velocity imparted to it by such rotation, and an additional velocity is imparted to such fluid in excess of the speed of rotation of the housing 10 because of the flow of the liquid through the restrictions provided by the inlet chokes 40*b*. Such inlet chokes provide for the free vortex flow which is in excess of the rotation of the accelerator A itself so that the liquid within the separation chamber 10*c* is moving at a velocity greater than the actual rotation of the housing 10, causing the solid heavier particles to move towards the outer portion of the housing 10 and creating a reduced pressure or partial vacuum within the central portion of such separation chamber 10*c*. Because of such partial vacuum, air enters through the annular space 34 into the bore 12*a* of the hollow outlet shaft 12 to form the central air core for the light phase discharge column 35 indicated in dash lines in FIG. 4A. Thus, the light phase discharge exits through the bore 33*c* of the re-entrant discharge tube 33 while the heavy phase discharges through the side or outlet openings 10*e* of the housing 10 and the chokes 30 therewith. The heavy phase discharge flows through the elliptical channel portion 50*h* of the heavy phase receiver unit 50 (FIG. 1) and is received in the sump 50*e* for discharge through opening 50*f* to the point of recovery of such heavy phase.

As noted previously, the stabilizer 42 provides for a relatively constant position of the light phase discharge column 35 centrally within the housing or bowl 10 so as to more accurately separate the heavy phase from the light phase.

The foregong disclosure and description of the invention are illustrative and explanatory thereof and various changes in the size, shape and materials as well as in the details of the illustrated construction may be made without departing from the spirit of the invention.

I claim:

1. A rotating cyclone apparatus for separating heavy solid phases from light solid phases in a liquid, comprising:

an elongate centrifuge housing with a separation chamber and having an axial inlet for liquid feed into the housing and a heavy phase outlet discharge through the side wall of the housing and a light phase outlet substantially in the central portion of the housing, with both of said outlets being at the opposite end portion of said separation chamber from said inlet;

means for introducing air into said housing at the light phase outlet in a direction opposite to the direction of the discharge of the light phase to form an air core in the light phase discharge at substantially the central portion of the housing;

means for rotating said housing for creating a forced vortex;

an accelerator mounted at the inlet end of said housing for rotation with said housing and for imparting a helical flow to the inlet liquid combining the forced vortex and a free vortex at a velocity in excess of the velocity of rotation of said housing;

a rotatable re-entrant discharge tube extending into said separation chamber at substantially the central portion thereof and forming a part of the light phase outlet from said separation chamber at the opposite end of said chamber from said inlet; and said re-entrant discharge tube extending into said separation chamber with its inlet opening inwardly of said heavy phase outlet discharge to inhibit a by-pass of the separated heavy phase outwardly with the light phase discharge.

2. A rotating cyclone centrifuge apparatus for separating heavy solid phases from light solid phases in a liquid, comprising:

an elongate centrifuge housing with a separation chamber and having an axial inlet for liquid feed into the housing and a heavy phase outlet discharge in the side of the housing and a light phase outlet substantially in the central portion of the housing, with both of said outlets being at the opposite end portion of said separation chamber from said inlet;

means for introducing air into said housing at the light phase outlet to form an air core in the light phase discharge at substantially the central portion of the housing;

means for rotating said housing;

an accelerator mounted at the inlet end of said housing for rotation with said housing and for imparting a helical flow to the inlet liquid at a velocity in excess of the velocity of rotation of said housing;

a rotatable re-entrant discharge tube extending into said separation chamber at substantially the central portion thereof and forming a part of the light phase outlet from said separation chamber at the opposite end of said chamber from said inlet;

said re-entrant discharge tube extending into said separation chamber with its inlet opening inwardly of said heavy phase outlet discharge to inhibit a by-pass of the separated heavy phase outwardly with the light phase discharge;

said accelerator comprising an accelerator body having an axial inlet and a pair of lateral passages which together extend for substantially the full diameter of said body;

said body also having a pair of restricted openings, one at each end of said lateral passages and each being of less radial distance than the length of each lateral passage; and said body further having a pair of substantially helical vanes, each of which terminates in proximity to one of said restricted openings at the outer extremity of said body and through which the inlet feed flows at an increased velocity into said separation chamber.

3. The structure set forth in claim 2, wherein:

the outer extremity of the bore of said separating chamber is substantially equal to the outer extremities of said restricted openings to permit unrestricted flow of the liquid feed from the restricted openings into the separation chamber to thereby avoid plugging of the restricted openings.

4. The structure set forth in claim 2, wherein:

said housing is cylindrical and said heavy phase outlet discharge includes a plurality of openings through the wall of the cylindrical housing.

5. The structure set forth in claim 4, wherein:

said re-entrant discharge tube extends into said separation chamber with its inlet opening inwardly of said plurality of openings to inhibit a by-pass of the separated heavy phase outwardly with the light phase discharge.

6. The structure set forth in claim 5, wherein:

said re-entrant discharge tube is removable for providing a central opening therethrough of a selected diameter for regulating the extent of separation of the two phases.

7. The structure set forth in claim 2, wherein:

said heavy phase discharge outlet is formed by a plurality of openings each of which has a removable choke, whereby each choke may be replaced to vary the size of the opening in each choke for regulating the extent of separation of the heavy phase solids in the liquid from the light phase solids.

8. The structure set forth in claim 2, including:

a receiving cover surrounding said housing and disposed to receive the heavy phase discharge from the housing outlet.

9. The structure set forth in claim 2, wherein:

said lateral passages are diametrically opposite each other and establish fluid communication from said axial inlet to said restricted openings; and the sum of the cross-sectional areas of said diametrically opposite lateral passages is substantially equal to the cross-sectional area of said inlet opening but is greater than the cross-sectional area of said restricted opening to prevent plugging of said restricted opening by the solids in the liquid feed while effecting an accelerated velocity flow of the feed through said restricted openings.

10. A rotating cyclone centrifuge apparatus for separating heavy solid phases from light solid phases in a liquid, comprising:

an elongate centrifuge housing with a separation chamber and having an axial inlet for liquid feed into the housing and an heavy phase outlet discharge in the side of the housing and a light phase outlet substantially in the central portion of the housing, with both of said outlets being at the opposite end portion of said separation chamber from said inlet;

means for introducing air into said housing at the light phase outlet to form an air core in the light phase discharge at substantially the central portion of the housing;

means for rotating said housing;

an accelerator mounted at the inlet end of said housing for rotation with said housing and for imparting a helical flow to the inlet liquid at a velocity in excess of the velocity of rotation of said housing, and an air core stabilizer in said separation chamber at the opposite end thereof from said light phase outlet and disposed in longitudinal alignment therewith, whereby a substantially central stablized core of light phase particles and liquid is formed in said departing chamber to effect a more definitive separation of the heavy phase particles therefrom.

* * * * *